US007132793B2

(12) United States Patent
Tsai et al.

(10) Patent No.: US 7,132,793 B2
(45) Date of Patent: Nov. 7, 2006

(54) FILAMENT ASSEMBLY FOR A TWINKLING BULB

(76) Inventors: Chin-Li Tsai, No. 47, Lane 80, Wenya St., Hsinchu (TW); Ching-Chu Chen, No. 364, Chengkung Rd., Hsinchu (TW)

( * ) Notice: Subject to any disclaimer, the term of this patent is extended or adjusted under 35 U.S.C. 154(b) by 171 days.

(21) Appl. No.: 10/919,542

(22) Filed: Aug. 16, 2004

(65) Prior Publication Data

US 2006/0033434 A1 Feb. 16, 2006

(51) Int. Cl.
*H01K 1/66* (2006.01)
*H05B 37/00* (2006.01)

(52) U.S. Cl. ..... 313/580; 313/578; 315/185 S

(58) Field of Classification Search ..... 313/578–580, 313/271–279; 315/185 S
See application file for complete search history.

(56) References Cited

U.S. PATENT DOCUMENTS 6,686,700 B1 * 2/2004 Hsu et al. ..... 315/185 R

* cited by examiner

*Primary Examiner*—Joseph Williams
*Assistant Examiner*—Bumsuk Won
(74) *Attorney, Agent, or Firm*—patenttm.us; James H. Walters

(57) ABSTRACT

A filament assembly for a twinkling bulb has first and second magnesium-plated filaments, a glass bead, a fuse and a tungsten filament. The second magnesium-plated filament is parallel to the first magnesium-plated filament and has a stop section and a flexible metal tongue. The stop section is formed on the second magnesium-plated filament. The flexible metal tongue is mounted on the second magnesium-plated filament above the stop section. When the twinkling bulb is electrified, the flexible metal tongue touches the first magnesium-plated filament intermittently and causes the twinkling bulb to twinkle.

1 Claim, 3 Drawing Sheets

FILAMENT ASSEMBLY FOR A TWINKLING BULB

BACKGROUND OF THE INVENTION

1. Field of the Invention

The present invention relates to a filament assembly, and more particularly to a filament assembly for a twinkling bulb.

2. Description of Related Art

The electric light bulb has illuminated the world for a century, bringing unimagined advances to our lives. The bulbs may also be used as a decoration for special occasions such as a birthday party or a Christmas party.

With reference to FIG. 3, a conventional twinkling bulb in accordance with the prior art comprises a bulb seat (not shown), a glass shell (90) and a filament assembly. The glass shell is transparent and mounted on the bulb seat. The filament assembly is mounted inside the glass shell on the bulb seat and has two magnesium-plated filaments (91), a glass bead (92), a fuse (93), a tungsten filament (94) and a flexible tongue (95). The magnesium-plated filaments (91) are mounted inside the glass shell (90) on the bulb seat, spaced apart a certain distance and respectively having a top end. The glass bead (92) is mounted to the magnesium-plated filaments (91) and both keeps the magnesium-plated filaments (91) upright and separate form each other. The fuse (93) is mounted around the magnesium-plated filaments (91). The tungsten filament (94) is mounted between the top ends of the magnesium-plated filaments (91). The flexible tongue (95) is mounted on one of the magnesium-plated filaments (91) and has two metal strips, a fixed end and a distal end. The metal strips are joined longitudinally and have different coefficient of thermal expansion. The fixed end is attached to one of the magnesium-plated filaments (91) and the distal end is separate from the other.

When the twinkling bulb is electrified, the current passes through the magnesium-plated filament (91), the fuse (93), the tungsten filament (94) and the flexible tongue (95). The tungsten filament (94) radiates heat and light and causes temperatures of all components inside the glass shell (90) to rise. As the temperature rises, the electrified flexible tongue (95) bends to touch the opposite magnesium-plated filament (91) to cause a short circuit. The tungsten filament (94) fails to radiate heat and light. Then, the temperature of the flexible tongue (95) accordingly falls and the distal end of the flexible tongue (95) separates from the opposite magnesium-plated filament (91) to make the tungsten filament (94) radiate heat and light up again.

The conventional twinkling bulbs can be assembled in series connection or in parallel connection to become a twinkling bulb assembly to be use as a decoration for a Christmas tree or celebratory items. When the bulb assembly is electrified, the bulbs light irregularly. However, the distal end of flexible tongue (95) does not not bend precisely back to the same position every time when the temperature thereof decreases. The distal end might bend to a position lower than a critical position resulting in that the distal end cannot bend again to the touch the opposite magnesium-plated filament and the twinkling function of the twinkling bulb fails. Furthermore, metal fatigue also causes the flexible tongue (95) to fail to bend properly and the twinkling function of the twinkling bulb again fails.

To overcome the shortcomings, the present invention provides a filament assembly for a bulb to mitigate or obviate the aforementioned problems.

SUMMARY OF THE INVENTION

The main objective of the invention is to provide a filament assembly for a twinkling bulb that ensures the twinkling bulb twinkles constantly.

The filament assembly for a twinkling bulb in accordance with the present invention comprises first and second magnesium-plated filaments, a glass bead, a fuse and a tungsten filament. The second magnesium-plated filament is parallel to the first magnesium-plated filament and has a stop section and a flexible metal tongue. The stop section is formed on the second magnesium-plated filament. The flexible metal tongue is mounted on the second magnesium-plated filament above the stop section.

Other objectives, advantages and novel features of the invention will become more apparent from the following detailed description when taken in conjunction with the accompanying drawings.

DETAILED DESCRIPTION OF PREFERRED EMBODIMENT

Figure 1:
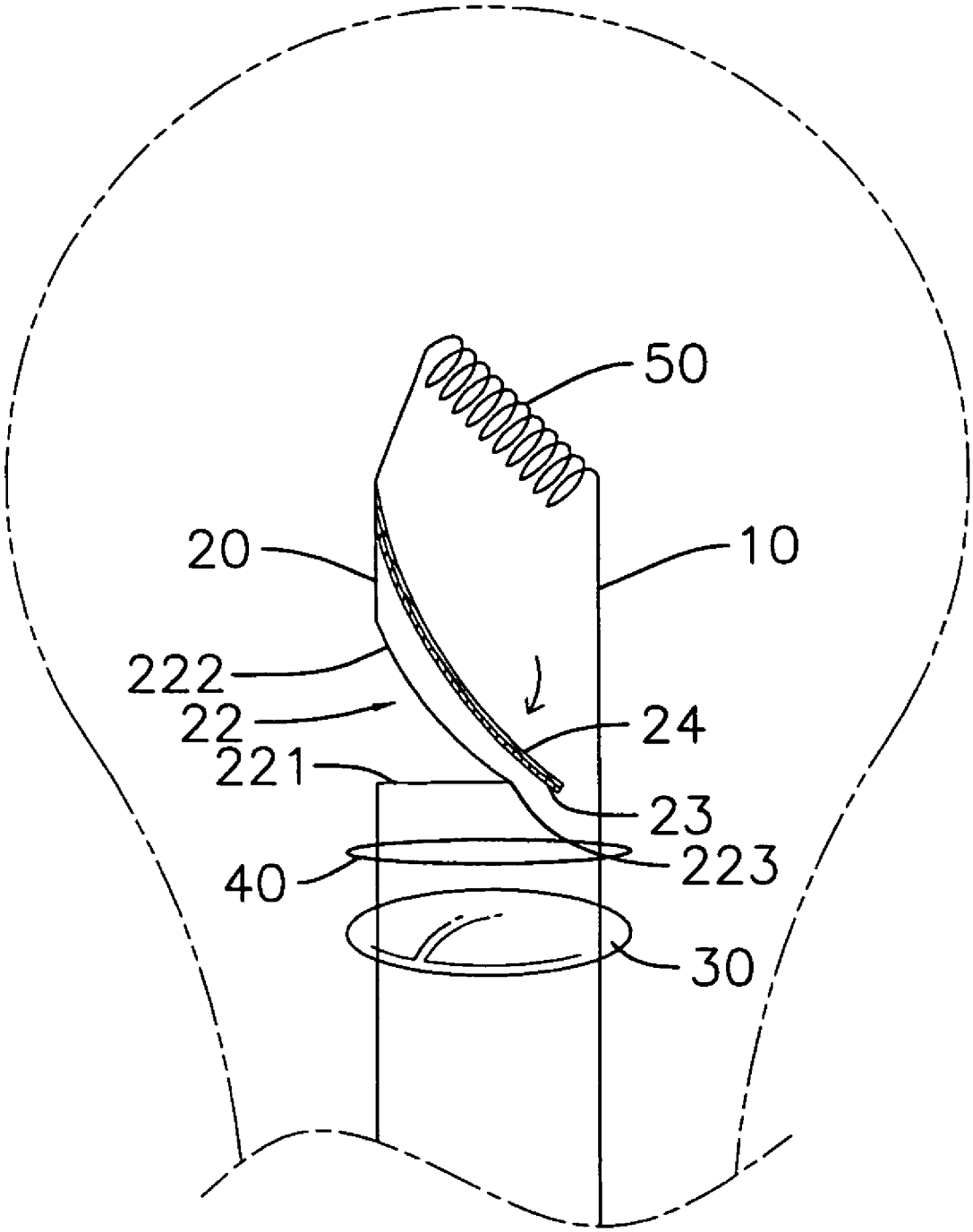
FIG. 1 is a front view in partial cross section of a filament assembly for a twinkling bulb in accordance with the present invention.

With reference to FIG. 1, a filament assembly for a twinkling bulb in accordance with the present invention is mounted inside a twinkling bulb. The twinkling bulb has a glass shell and a bulb seat (not shown). The glass shell is mounted on the bulb seat.

The filament assembly for a twinkling bulb in accordance with the present invention comprises a first magnesium-plated filament (10), a second magnesium-plated filament (20), a glass bead (30), a fuse (40) and a tungsten filament (50).

The first and second magnesium filaments (10, 20) are mounted inside the glass shell on the bulb seat, spaced apart a distance, parallel to each other and each has a top end. The second magnesium-plated filament (20) has a stop section (22) and a flexible metal tongue.

The stop section (22) is formed on the second magnesium-plated filament (20) and has a support section (221), a curved section (222) and a contact point (223). The support section (221) is formed on the second magnesium-plated filament (20) and has a right end. The curved section (222) is formed on the second magnesium-plated filament (20), connected to the support section (221) and has a right end connected to the right end of the support section (221). The contact point (223) is defined on the right ends respectively of the support section (221) and the curved section (222).

The flexible metal tongue is mounted on the second magnesium-plated filament (20), located above the stop section (22), curved to and corresponds to the curved section (222) and has a first metal strip (23), a second metal strip (24), a fixed end and- a distal end. The first metal strip (23) is located on the stop section (22) and has a coefficient of thermal expansion. The second metal strip (24) is mounted longitudinally on the first metal strip (23) and has a coefficient of thermal expansion smaller than that of the first metal strip (23). The fixed end is attached to the second magnesium-plated filaments (20) and the distal end is separate from the first magnesium-plated filament (10).

The glass bead (30) is mounted to the first and second magnesium-plated filaments (10, 20) below the stop section (22) and both keeps the first and second magnesium-plated filaments (10, 20) upright and separate from each other.

The fuse (40) is mounted around the first and second magnesium filaments (10, 20) between the stop section (22) and the glass bead (30).

The tungsten filament (50) is mounted between the top ends respectively of the first and second magnesium-plated filaments (10, 20).

Figure 2:
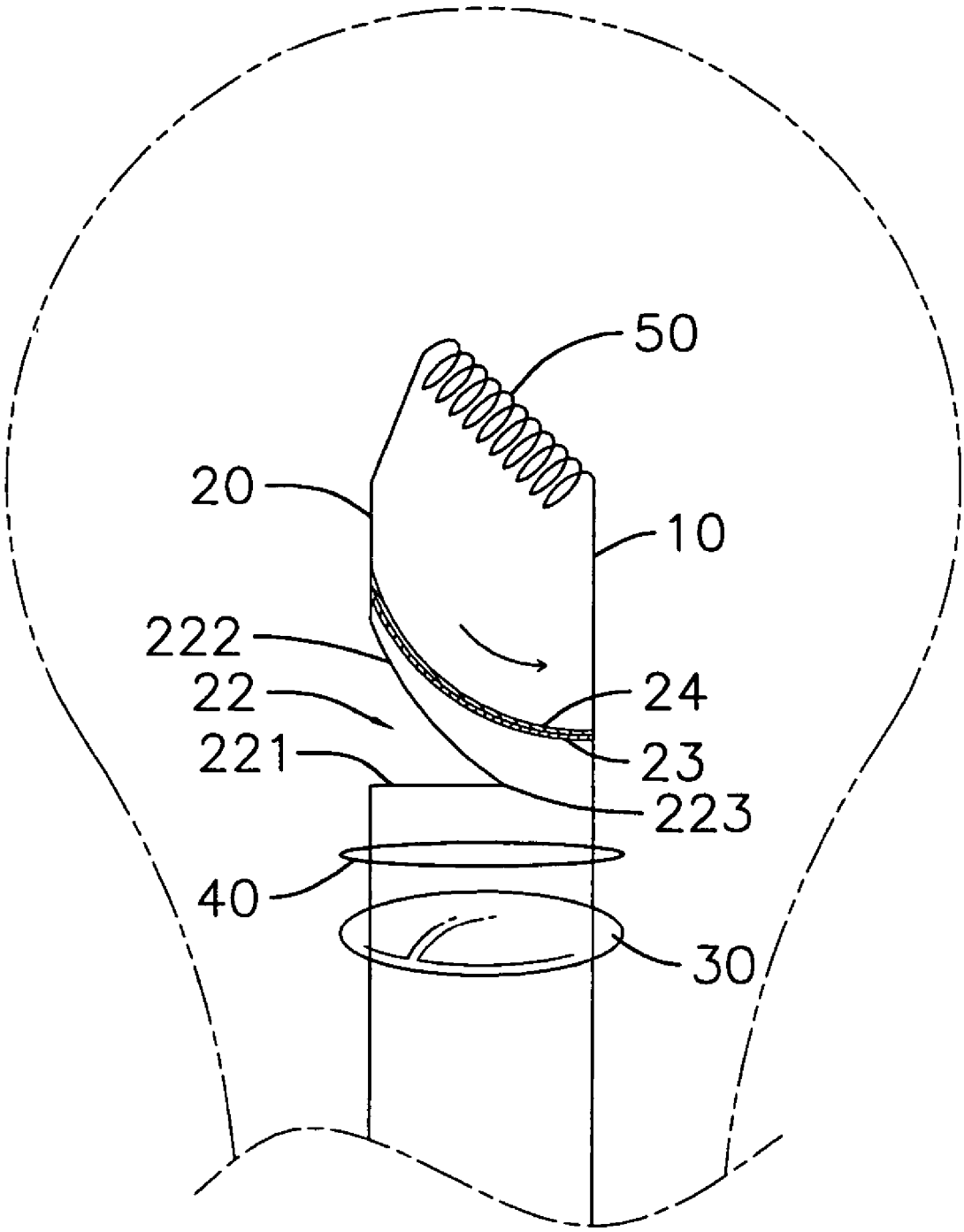
FIG. 2 is an operational front view in partial cross section of a filament assembly for a twinkling bulb in FIG. 1.
Figure 3:
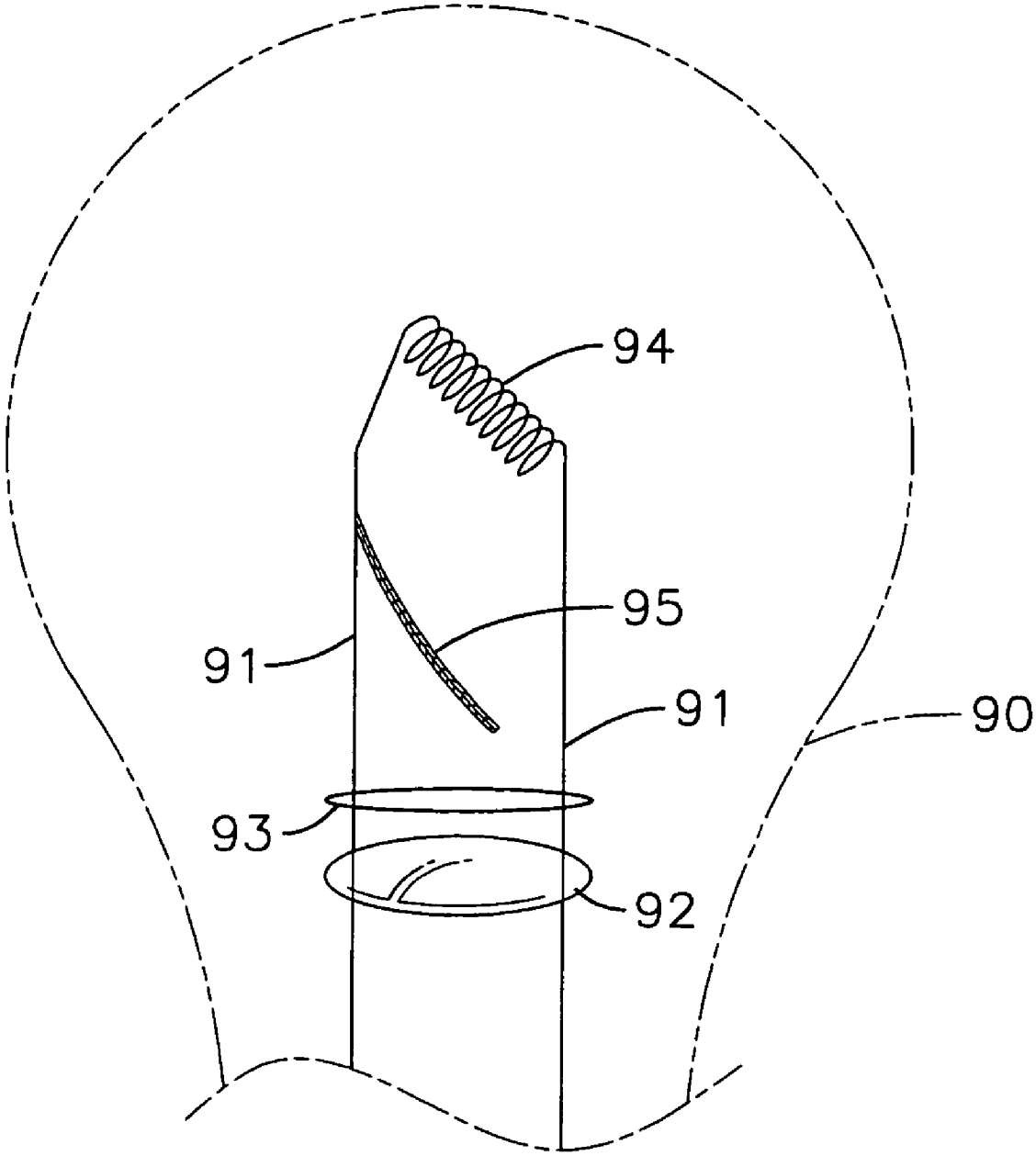
FIG.3 PRIOR ART
FIG. 3 is a front view in partial cross section of a filament assembly for a conventional twinkling bulb in accordance with the prior art.

With reference FIG. 1, when the twinkling bulb is not electrified, the flexible metal tongue is located above the curved section (222) and is spaced from the first magnesium-plated filament (10). With reference to FIG. 2, the twinkling bulb is electrified and the current passes through the first and second magnesium-plated filaments (10, 20), the flexible metal tongue, the fuse (40) and the tungsten filament (50). The tungsten filament (50) radiates heat and light and causes temperatures of all components inside the glass shell to rise. As the temperature rises, the flexible metal tongue bends such that the distal end touches the first magnesium-plated filament (10) and causes a short circuit, whereby the tungsten filament (50) fails to radiate heat and light. Then, the temperature of the flexible metal tongue decreases and the flexible metal tongue bends back to be located against the curved section (222) or the contact point (223) of the stop section (22). The distal end of the flexible metal tongue separates from the first magnesium-plated filament (10) to make the tungsten filament (50) radiate heat and light again. Intermittent contacts of the flexible metal tongue and the first magnesium-plated filament (10) cause the twinkling bulb to twinkle irregularly. In addition, the extent of the curvatures of the curved section (222) and the flexible metal tongue can be changed to determine the frequency of the twinkling of the twinkling bulb.

Because the stop section (22) prevents excessive bending of the flexible metal tongue at a low temperature, the flexible metal tongue is sure to bend to touch the first magnesium-plated filament (20) at high temperature and cause a short circuit. Therefore the twinkling bulb of the invention has good reliability and long useful life.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A filament assembly for a twinkling bulb comprising:

a first magnesium-plated filament having a top end;

a second magnesium-plated filament spaced from and parallel to the first magnesium-plated filament and having a top end;

a stop section formed on the second magnesium-plated filament and having a support section formed on the second magnesium-plated filament and having a right end;

a curved section formed on the second magnesium-plated filament, connected to the support section and having a right end connected to the right end of the support section;

a contact point defined on the right ends respectively of the support section and the curved section; and a flexible metal tongue mounted on the second magnesium-plated filament, located above the stop section, curved to and corresponding to the curved section and having a fixed end attached to the second magnesium-plated filaments; and a distal end separate from the first magnesium-plated filament;

a glass bead mounted to the first and second magnesium-plated filaments below the stop section and keeping the first and second magnesium-plated filaments upright and separate from each other;

a fuse mounted around the first and second magnesium filaments between the stop section and the glass bead; and a tungsten filament mounted between the top ends respectively of the first and second magnesium-plated filaments.

* * * * *